United States Patent [19]

Knoop

[11] Patent Number: 4,835,865

[45] Date of Patent: Jun. 6, 1989

[54] HOLLOW-HANDLE UTILITY KNIFE REPLACEABLE BLADE

[75] Inventor: Heinz-Peter Knoop, Solingen, Fed. Rep. of Germany

[73] Assignee: Martor-Argentax E.H. Beermann KG, Solingen, Fed. Rep. of Germany

[21] Appl. No.: 65,337

[22] Filed: Jun. 22, 1987

[30] Foreign Application Priority Data

Jul. 3, 1986 [DE] Fed. Rep. of Germany ..... 3622343

[51] Int. Cl.[4] ..... B26B 1/08

[52] U.S. Cl. ..... 30/162; 30/335

[58] Field of Search ..... 30/162, 163, 335, 336

[56] References Cited

U.S. PATENT DOCUMENTS

| | | | |
|---|---|---|---|
| 1,507,043 | 9/1924 | Blow | 30/162 |
| 2,862,296 | 12/1958 | Anderson | 30/162 |
| 4,517,741 | 5/1985 | Castelluzzo | 30/162 |

FOREIGN PATENT DOCUMENTS

| | | |
|---|---|---|
| 2704019 | 8/1978 | Fed. Rep. of Germany . |
| 2736395 | 11/1978 | Fed. Rep. of Germany . |
| 1511889 | 5/1978 | United Kingdom . |

*Primary Examiner*—Douglas D. Watts

*Attorney, Agent, or Firm*—Herbert Dubno

[57] ABSTRACT

A knife comprises a substantially hollow handle, a short knife blade guided longitudinally movable in a knife blade guide track and at least one guided slider member coupled indirectly with the handle side of the longitudinally movable knife blade. The slider member is provided or associated with a longitudinal slot, in some cases penetrating the handle to reach the exterior, and an operating piece. An especially simple replacement of the knife blade is possible since the knife blade is insertable at least indirectly in the knife blade guide track through the longitudinal slot which is designed to meet its spatial requirements. There the knife blade is form-locked and releasably lockable on the slider member which is at least partially removable from the handle.

15 Claims, 2 Drawing Sheets

HOLLOW-HANDLE UTILITY KNIFE REPLACEABLE BLADE

CROSS REFERENCE TO RELATED APPLICATION

This application is related to my application Ser. No. 07 065,331 filed June 22, 1987 which is hereby incorporated by reference herein.

FIELD OF THE INVENTION

My present invention relates to a hollow handle knife and, more particularly, to a utility knife with a replaceable slidable knife blade.

BACKGROUND OF THE INVENTION

A knife with a hollow handle is described in U.S. Pat. No. 2,862,296. The knife comprises a short knife blade longitudinally movable in a knife blade guide track and at least one guided slider member indirectly coupled with the longitudinally movable knife blade on the handle side of the knife blade, which are associated with an operating piece and a longitudinal slot penetrating the handle to reach the outside.

With the known knife the effort required to exchange the knife blade which is a trapezoidal blade is disadvantageous. The connecting screw which holds both longitudinal halves of the conventional handle together must first be unscrewed or removed. Then the slider member coupled with the longitudinally movable knife blade must be taken out for replacement of the knife blade.

By "short knife blade" I means a short trapezoidal blade, rectangular blade or hook blade—rather than a strip-like blade from which successive portions are broken off to restore a cutting edge. Thus a short knife blade is in fact used which is made predominantly of band steel and usually is not sharpened after it becomes blunt but is disposed of and replaced by a new knife blade.

OBJECTS OF THE INVENTION

It is an object of my invention to provide an improved industrial hollow-handle knife with a replaceable knife blade whereby these drawbacks are obviated.

It is also an object of my invention to provide an improved knife with a hollow handle, particularly a knife with a replaceable knife blade, in which without substantial effort and time consuming manipulations a blunt, broken or worn knife blade can be readily and safely replaced with a new knife blade.

SUMMARY OF THE INVENTION

These objects and others which will become more readily apparent hereinafter are attained in accordance with my invention in a knife comprising a hollow handle, a short knife blade guided longitudinally in a knife blade guide track of the handle and at least one guided slider member indirectly coupled with the handle side of the longitudinally movable knife blade and an operating piece associated with the slider member. The handle is provided with a longitudinal slot through which the handle reach from or to the outside.

According to my invention the knife blade is insertable in the knife blade guide track at least indirectly through the longitudinal-slides slot which thus must suit the spatial requirements of the knife blade and is then releasably locked and engaged by at least one of the slider members at least partially removable from the handle.

In the knife according to my invention the slider member or a portion of it with the knife blade, in the retracted position where the knife blade is withdrawn completely into the handle, is easily released and can be removed through the longitudinal-slides slot open to the exterior so that the knife blade can be released.

Thus the exchange of the blunt knife blade can be performed.

After the blunt blade is taken out through the longitudinal-slides slot, a new blade can be substituted for it.

That new blade is inserted through the longitudinal slot into its mounted position and is form-locked by the slider member or by a portion of it (advantageously the knife blade's inner broad side is form-locked) and is locked on the slider member.

According to a first embodiment of my invention the longitudinal slot has a width corresponding to the knife blade and is located on an outer broad side of the handle. The slider member has a slider cover contacting on the outer broad side of the knife blade. This slider cover can be easily at least partially released and, when it is advantageously pivotally mounted or connected on one end on the slider member, the blunt knife blade is removable for replacement with a new knife blade.

The easily releasable locking of the slider cover can occur in a variety of ways, advantageously by snap lock means which provide a detachable locking of the slider cover on the slider member.

The joint axis between the slider cover and the slider member can be oriented transverse to the feed direction of the knife blade and parallel to the transverse axis of the handle.

The joint axis can be located on a place spaced from the cutting end of the handle.

The slider cover simultaneously can be a slider operating piece.

An alternative or additional slider operating piece can be provided which is attached to the slider member in a compression resistant way and projects through an operating piece slot extending parallel to the longitudinal axis of the handle. It can be located on the top side of the handle.

In a second basic embodiment according to my invention the slider member and the knife blade are removable jointly through a longitudinal-slides slot extending in the longitudinal direction of the handle and provided on the narrow top side of the handle.

Advantageously the slider member with the knife blade in the retracted position are pivotable about a pivot pin extending transverse to the handle surface.

The slider member can be provided with an elongated slot extending in the longitudinal direction of the handle in which the pivot pin is received. The end of the elongated slot furthest from the cutting end contacts the pivot pin when the knife blade is in the cutting position.

In a particularly advantageous construction of this second embodiment, the handle has a guide groove extending in the longitudinal direction of the handle in a displaced position relative to the pivot pin which can release a guide extension projecting laterally from the slider member received and longitudinally slidable therein at the end of the guide groove furthest from the cutting end for swinging out the slider member. The guide extension can be shaped like a bar.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
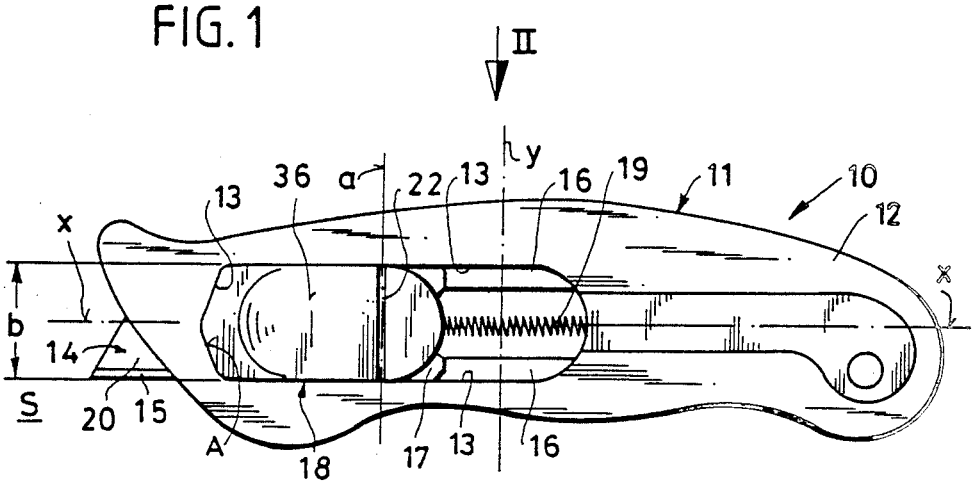
FIG. 1 is a side elevational view of a knife according to my invention.
Figure 2:
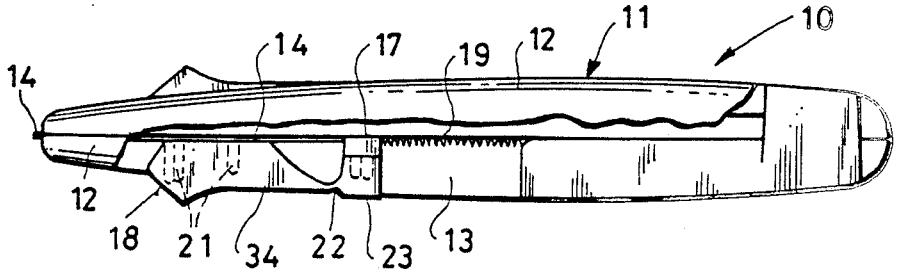
FIG. 2 is a top plan view of a knife according to FIG. 1 as seen in the direction of the arrow II of FIG. 1, in which the longitudinal halves of the handle are partially broken away so that an easily releasably lockable slider cover holding the knife blade while the knife blade is located in its forward cutting position can be seen.
Figure 3:
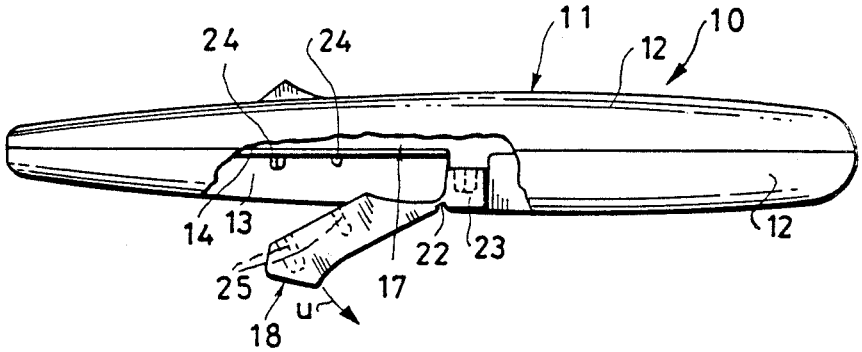
FIG. 3 is top view of the knife according to FIGS. 1 and 2 similar to that illustrated in FIG. 2 but with the slider cover pivoted out.
Figure 4:
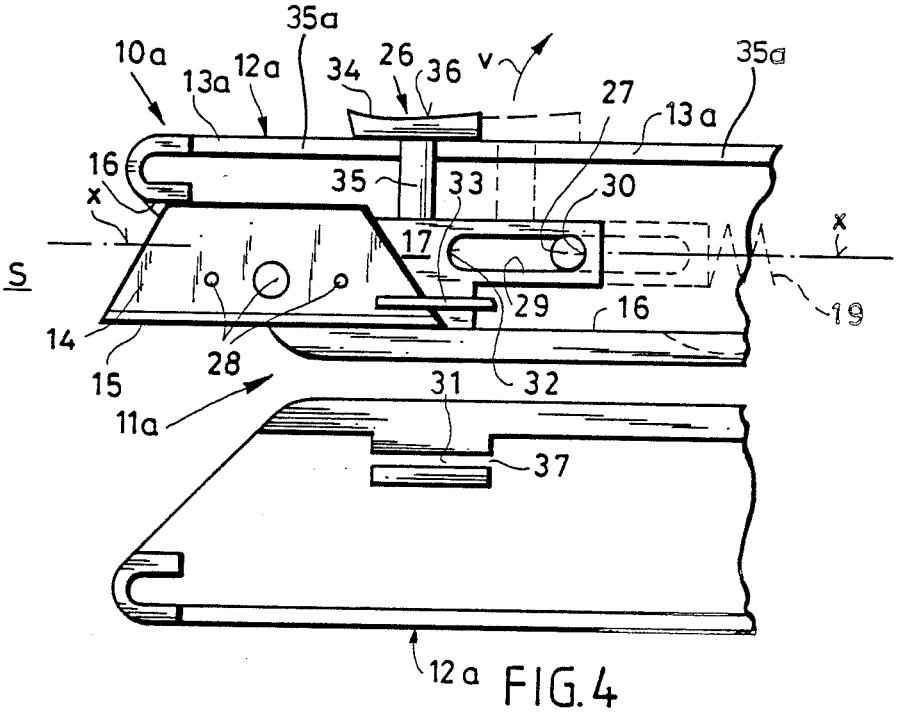
FIG. 4 is a partially cutaway side elevational view of another example of a knife according to my invention in which the operation of the components of the knife are better illustrated by folding back from each other both longitudinal halves of the hollow handle of the knife.

The knife as a whole is indicated at 10 in FIGS. 1 to 3 with or at 10*a* in FIG. 4.

Each knife shown has a substantially hollow handle 11 (FIGS. 1 to 3) and/or 11*a* (FIG. 4) which comprises two longitudinal handle halves 12 (FIGS. 1 to 3) or 12*a* (FIG. 4).

According to FIGS. 1 to 3 a longitudinal-slides slot 13 in one side (i.e. in one longitudinal handle half 12) of the handle 11 is provided which extends across the entire thickness of one longitudinal handle half 12.

The width b of the longitudinal-slides slot 13 is somewhat larger than the width of the knife blade 14 with the cutting edge 15.

In the present case the knife blade 14 is shown as a trapezoidal blade.

The longitudinal handle halves 12 as seen in FIG. 1 form two knife blade guide tracks 16 on which the knife blade 14 is guided not directly but by means of an interior slider member 17 longitudinally slidable parallel to the handle longitudinal axis x.

In FIGS. 1 and 2 the knife blade 14 is located in its cutting position, i.e. the interior slider member 17 is pushed entirely forward to the cutting end indicated with S. A slider cover 18 whose front is approximately V shaped is pushed to a corresponding stop A of the longitudinal-slides slot 13.

The longitudinal sliding of the interior slider member 17 with a slider cover 18 forward to the cutting end S occurs against the restoring force of a tension providing spring 19.

As soon as the slider cover 18 provided with the slider operating piece 34 is no longer pushed forward with the thumb the tension providing spring 19 pulls the slider member and cover 17, 18 together back with the knife blade 14 into the resting position (FIG. 3) so that the knife blade 14 is entirely back inside the handle 11. Thus the knife blade 14 with its entire blade lateral side 20 is located inside the longitudinal-slides slot 13.

The removal of the knife blade 14 completely in its retracted position (FIG. 3) is effected as follows:

First the knife blade 14 is releasably held locked in its pushed forward cutting position between the interior slider member 17 and the slider cover 18 according to the illustrations shown in FIGS. 1 and 2. The releasable locking occurs by snap lock means 21 which are shown with dashed lines in FIG. 2.

After the tension spring 19 is effective to retract the knife blade 14 jointly with the interior slider member 17, and the slider cover 18 is located in the retracted resting position according to FIG. 3.

Since the slider cover 18 is held by a film frame hinge joint 22 to a knee piece 23 and it is held on the inner slider member 17, the slider cover 18 may be detached in the pivot direction u so that the knife blade 14 can be taken out through the wide longitudinal-slides slot 13 and a new knife blade 14 can be substituted for it.

From FIG. 3 it is apparent that the snap lock means 21 comprise undercut upper roll like locking and/or centering pins 24 of the interior slider member 17 and corresponding undercut matrix like locking recesses 25 of the slider cover 18. As soon as a new knife blade 14 is substituted the slider cover 18 is again put in its locked position (compare with FIGS. 1 and 2).

It should be mentioned that the joint axis a of the film frame hinge joint 22 extends parallel to the transverse axis y of the handle 11.

The slide parts (i.e. 17, 18)—together with the knee piece 23—are appropriately made of a suitable plastic by die casting or injection molding. Both handle longitudinal halves 12 can be made by injection molding of a plastic or die casting of a metal.

In the embodiment shown in FIG. 4—in so far as possible —similar parts are given the same reference character as corresponding parts in the example of FIGS. 1 to 3.

The embodiment of FIG. 4 has a longitudinal-slides slot 13a in the top of the handle 11a. The knife blade 14 is located in its operating position shoved forward toward its cutting end S. The slider unit 26, 27 is provided so that the knife blade 14 in the retracted resting position of the slider member 26 jointly with the latter can be pivoted about a pivot pin 27 projecting interiorly from a longitudinal handle half 12 out from the longitudinal-slides slot 13*a* accordingly in the pivot direction v as indicated by the dashed lines in FIG. 4.

In the not illustrated pivoted out position the knife blade 14 can be pulled away laterally from the centering pins 28 and a new knife blade can be substituted for it.

The slider and/or slider member 26 has an elongated slot 29 extending in the handle longitudinal direction x in which the pivot pin 27 is received. The end 30 of the slot 29 furthest from the the cutting end S contacts on the pivot pin 27 with the knife blade 14 in the cutting position.

The handle longitudinal half 12*a* shown folded down has a short longitudinal guide groove 31 extending in the handle longitudinal direction x which is open at both its ends. A guiding extension 33 formed like a bar protruding laterally from the slider member 17 and overlapping the rear end of the knife blade 14 partially with some clearance is engaged in the guide groove 31 guiding the knife blade 14 in a longitudinally sliding motion.

When the slider member 26 with its elongated slot 29 is moved from the cutting end S entirely rearward, the pivot pin 27 is thereof repositioned to the front end of the elongated slot 29 so that the bar like extension 33 is already located outside the guide groove 31. Thus, the pivoting of the unit including slider member 26 and the knife blade 14 in the direction v for exchange of the knife blade 14 can proceed unhindered.

The slider operating piece 34 extending laterally from the slider member 26 is connected by a connecting bar 35 with the interior slider member 17 and projects through an operating piece slot 35*a*. The entire slider member 26 can be made of plastic by injection molding or casting. The longitudinal handle half 12*a* can be either be made by metal die casting or plastic injection molding or casting.

The slider operating piece surfaces are indicated with 36. The end of the guide groove 31 furthest from the cutting end S is indicated with a 37.

I claim:

1. In a knife comprising a substantially hollow handle, a short knife blade having a handle end and a cutting end movable longitudinally in a feed direction in a knife blade guide track, at least one guided slider member coupled indirectly with the handle end of said longitudinally movable knife blade, a slider operating piece including a slider cover and associated with said slider member, and said handle of said knife being provided with a longitudinal-slide slot, the improvement wherein said knife blade is insertable in said knife blade guide track at least indirectly through said longitudinal-slide slot and is there releasably locked and engaged by said slider member, said slider cover is at least partially removable from said knife blade guide track through said slot, said longitudinal-slide slot is formed to fit the spatial requirements of said knife blade by having a width corresponding to that of said knife blade and said slot is located on one side of said handle, said slider member is provided with said slider cover on an outer broad side of said knife blade, and an inner broad side of said knife blade is held form-fittingly in said slider member guided in said knife blade guide track while said slider cover contacting on said outer broad side of said knife blade is locked on said slider member.

2. The improvement according to claim 1 wherein said slider cover is held by snap lock means on said slider member.

3. The improvement according to claim 1 wherein said slider cover is pivotally mounted on one end of said slider cover on said slider member.

4. The improvement according to claim 3, wherein a joint axis in a plane dividing said slider cover from said slider member is oriented transverse to a feed direction of said knife blade and parallel to a transverse axis of said handle.

5. The improvement according to claim 4, wherein said joint axis is spaced from a cutting end of said knife at which said projecting side of said knife blade is adapted to extend.

6. The improvement according to claim 1 wherein said slider cover simultaneously is a slider operating piece.

7. The improvement according to claim 1, further comprising another slider operating piece attachable to said slider member in a compression resistant way and projecting through an operating piece slot formed parallel to a longitudinal axis of said handle and provided in a top side of said handle.

8. The improvement according to claim 1 wherein said slider member and said knife blade are removable jointly through a longitudinal-slide slot extending in a longitudinal direction of said handle and provided on a top side of said handle.

9. The improvement according to claim 8, wherein said slider member with said knife blade in a retracted position of said knife blade is pivotable about a pivot pin extending perpendicular to the knife blade.

10. The improvement according to claim 9 wherein said slider member is provided with an elongated hole extending in said longitudinal direction of said handle and receiving said pivot pin, an end of said elongated hole furthest from the cutting end of said knife contacting said pivot pin when said cutting end of said knife blade is in a cutting position projecting from said handle.

11. The improvement according to claim 10, wherein said handle has a guide groove extending in said longitudinal direction of said handle in a displaced position relative to said pivot pin which releases a guide extension projecting laterally from said slider member received and longitudinally slidable therein at an end of said guide groove furthest from said cutting end for pivoting out of said slider member.

12. The improvement according to claim 11 wherein said guide extension is shaped like a bar.

13. A knife comprising:

a substantially hollow handle provided with a longitudinal-slide slot on one side of said handle;

a short knife blade movable longitudinally in a knife blade guide track insertable in said knife blade guide track at least indirectly through said longitudinal-slide slot which fits the spatial requirements of said knife blade;

at least one guided slider member coupled indirectly with a handle end of said longitudinally movable knife blade;

a slider operating piece associated with said slider member comprising a slider cover on an outer broad side of said knife blade pivotally mounted on said one side on said slide member, said slider cover being at least partially removable from said knife blade guide tract and releasably lockable with and engaged with said knife blade; and snap lock means for holding said slider cover on said slider member.

14. A utility knife comprising:

an elongated hollow handle formed with an internal guide path terminating at an open end of said handle;

a slider received in said handle and displaceable along said guide path, said handle having an elongated slot;

a blade replaceably mounted in said handle, coupled to said slider, and adapted to project through said open end in an advanced position of said slider, said slider having an actuator extending through said slot and enabling displacement of said slider and said blade along said path; and a tension spring in said handle connected to said slider for drawing said blade into a retracted position in said handle upon release of said actuator, said slider having at least one swingable member adapted to pivot through said slot in said retracted position to permit said blade to be replaced on said slider through said slot without disassembly of the handle.

15. The utility knife defined in claim 14 wherein said seat is in a broad face of said handle and said member is a flap swingable on said slider and adapted to retain said blade in place.

* * * * *